United States Patent [19]

Grimmer

[11] Patent Number: 5,056,601

[45] Date of Patent: Oct. 15, 1991

[54] AIR COMPRESSOR COOLING SYSTEM

[76] Inventor: John E. Grimmer, 3 Susan La., Trafalgar, Ind. 46181

[21] Appl. No.: 541,778

[22] Filed: Jun. 21, 1990

[51] Int. Cl.[5] ..... F01M 5/00; F01P 11/08; F16D 31/02

[52] U.S. Cl. ..... 165/47; 165/41; 165/51; 184/6.22; 184/104.1; 60/456; 60/912; 417/228; 417/231; 417/364; 123/41.33

[58] Field of Search ..... 417/364, 231, 228, 243; 60/456, 912; 184/6.22, 104.1; 123/41.33; 165/41, 47, 51

[56] References Cited

U.S. PATENT DOCUMENTS

| | | | |
|---|---|---|---|
| 1,989,585 | 1/1935 | Bigelow | 184/104.1 |
| 2,063,436 | 12/1936 | Hild | 123/41.33 |
| 2,729,203 | 1/1956 | Prendergast | 123/41.33 |
| 2,867,376 | 1/1959 | Keir et al. | 417/228 |
| 3,078,805 | 2/1963 | Pezzillo | 103/87 |
| 3,153,508 | 10/1964 | Sawyer | 230/39 |
| 3,187,498 | 6/1965 | Firth et al. | 60/456 |
| 3,835,822 | 9/1974 | Mickle et al. | 123/41.31 |
| 4,232,997 | 11/1980 | Grimmer et al. | 417/26 |
| 4,520,767 | 6/1985 | Roettgen et al. | 123/41.33 |
| 4,535,729 | 8/1985 | Faylor | 123/41.33 |

OTHER PUBLICATIONS

Brochure "PTO Driven 135/175 GrimmerSchmidt Compressors."

Audels New Automobile Guide, reprint 1945 pp. 470–471.

McGraw-Hill Encyclopedia of Engineering, 1983 p. 348.

*Primary Examiner*—John K. Ford

*Attorney, Agent, or Firm*—Woodard, Emhardt, Naughton Moriarty & McNett

[57] ABSTRACT

A compressor cooling system is provided for use with an engine PTO driven oil-flooded air compressor. The compressor cooling system includes an oil flow path from the compressor oil outlet, through an oil/coolant heat exchanger, and to the compressor oil inlet. The system further includes a coolant flow path in fluid communication with the engine cooling system with the oil/coolant heat exchanger interposed in the coolant flow path. Thus, coolant flowing through the engine cooling path also flows through the oil/coolant heat exchanger in heat transfer relation with the compressor oil flowing therethrough. The compressor coolant flow path is integrated into the engine cooling system so that flow through the compressor coolant flow path is not interrupted by operation of the thermostatic bypass valve in the engine cooling system.

4 Claims, 3 Drawing Sheets

AIR COMPRESSOR COOLING SYSTEM

BACKGROUND OF THE INVENTION

The present invention relates generally to the compressor art, and more particularly to a novel and improved cooling system for providing cooling to an oil-flooded air compressor. More specifically, the present invention concerns such an oil cooling system that operates in conjunction with the engine cooling system of a vehicle.

Generally, compressors, such as air compressors, are driven by some external prime mover. This prime mover may be an electric motor or an internal combustion engine. The compressors supply compressed air to a receiver tank from which the compressed air is drawn for usage by various pneumatic devices. Certain portable compressors are packaged within their own utility trailer or are separately mounted on a skid that can be moved to a job site. These compressor units are self-contained in that they include their own prime mover, compressor and cooling system for the compressor.

However, another type of compressor can be driven directly by the engine of a vehicle, such as a truck. More specifically, certain compressor units are driven by a power take-off (PTO) from the vehicle engine or transmission. As shown in FIG. 1, a typical compressor 10 can be mounted to the truck frame. The truck includes an internal combustion engine which provides a motive force through a transmission. A drive shaft from the transmission provides power to the rear drive wheels of the truck. In addition, most truck transmissions include a PTO for providing a source of auxiliary power to be used by an external device. In vehicle mounted air compressor assemblies, the PTO shaft provides power to the compressor unit. Another method of using a truck engine to power the compressor employs a split-shaft device in which a second transmission is mounted in the drive shaft.

During the operation of most air compressors, a great amount of heat is built up in the working components as the air is compressed. In one type of compressor known as a monoscrew compressor, offered by the GrimmerSchmidt Corporation of Franklin, Ind., an axial rotor includes rotor grooves which intermesh with fingers of a pair of oppositely disposed star slides. As the rotor turns, the fingers of the star slides mesh within the rotor grooves trapping air in the grooves and compressing the air as it is pushed toward a discharged port at the end of the rotor. Compressors of this sort are generally oil flooded—that is, oil is injected into the rotor groove just after the star finger has closed an end of the groove. The oil, which can be automatic transmission fluid, seals and lubricates the rotor and the star slide and provides cooling for the working parts of the rotor as well as for the compressed air exiting the compressor. Consequently, it is important that the oil used to lubricate and seal the compressor is cooled to improve the operational characteristics of the compressor and to insure that the compressed air is not too hot for immediate use.

A similar oil flow system can be used for vane, twin-screw, scroll and other rotary and flooded compressors.

SUMMARY OF THE INVENTION

The present invention is an air compressor cooling system for use with an engine driven oil-flooded air compressor. In one aspect, the compressor cooling system includes an oil flow path from the outlet of the air compressor, through an oil/coolant heat exchanger, and to the inlet of the compressor. The system further includes a coolant flow path passing from the coolant outlet of the engine, through the oil/coolant heat exchanger, and to the engine cooling system prior to the engine heat exchanger or radiator. The compressor coolant path is separate from but in fluid communication with the engine coolant path so that the same coolant flows through both systems. Thus, the engine thermostat controls the temperature of the common coolant, thereby eliminating the need for a separate compressor cooling system thermostat.

In one specific embodiment, the coolant flow path includes a coolant line from the outlet of the oil/coolant heat exchanger to the inlet of the engine coolant pump to be commingled with coolant entering the engine block. Warm coolant from the oil/coolant heat exchanger flows through this line having had its temperature increased by heat transfer with the warm oil exiting the air compressor. A second coolant line is connected to the engine coolant manifold inlet, upstream from the engine thermostat, to receive coolant from the engine radiator that has had its temperature reduced by heat exchange with air flowing over the radiator.

It is one object of the present invention to provide a cooling system for an engine driven air compressor, and particularly an oil-flooded air compressor. It is a further object to present such a cooling system that is less expensive and less complicated to implement than compressor cooling systems of the prior art.

Another object of the present invention is to provide an air compressor cooling system that is easily integrated with the cooling system of the engine that drives the compressor. An additional object inheres in a feature of the invention that permits use of the engine thermostat to control the temperature of the air compressor oil and that allows for faster warm-up of the compressor oil. Other objects and benefits of the present invention will become apparent from the following written description and accompanying drawings.

DESCRIPTION OF THE PREFERRED EMBODIMENT

Figure 1:
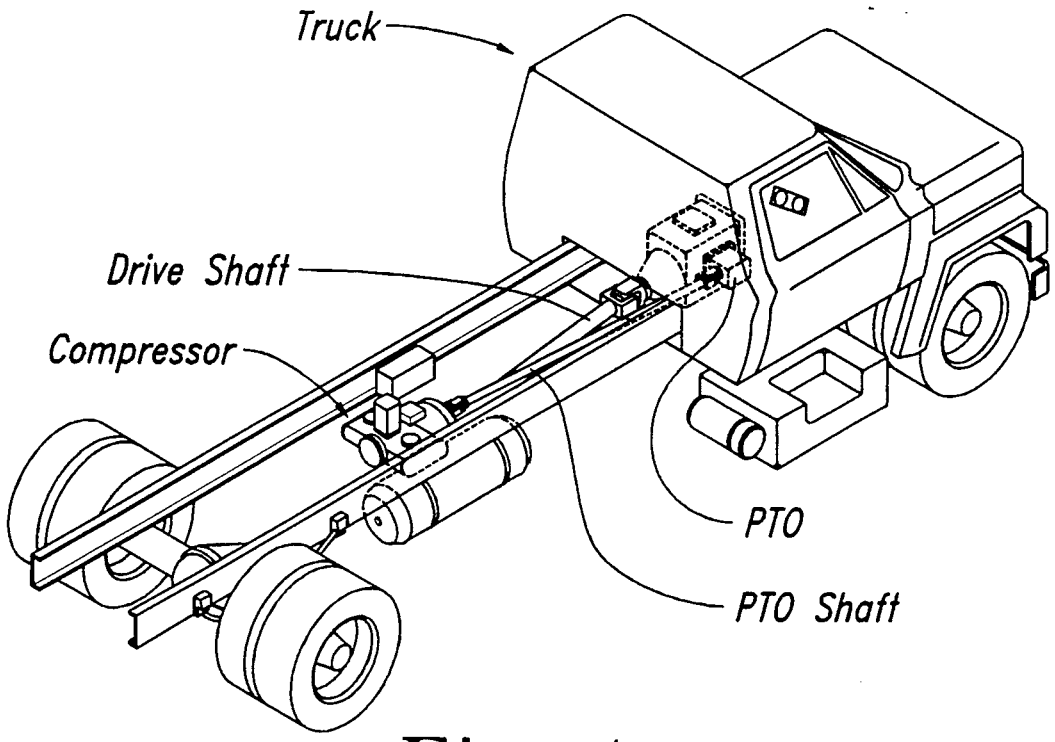
FIG. 1 is a perspective view of a truck including a compressor for use with the cooling system of the present invention.

For the purposes of promoting an understanding of the principles of the invention, reference will now be made to the embodiment illustrated in the drawings and specific language will be used to described the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
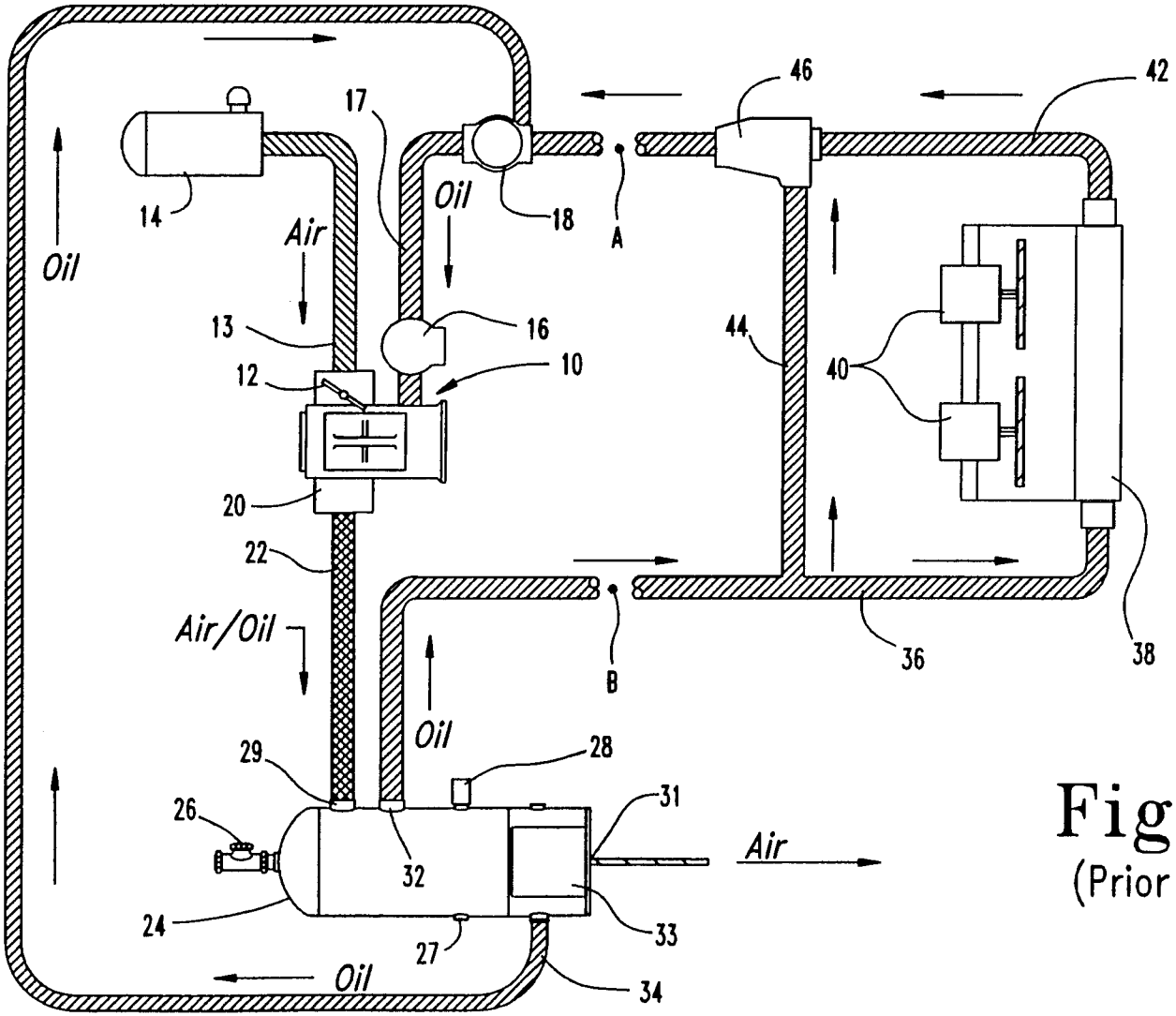
Fig. 2 (Prior Art)
FIG. 2 is a schematic representation of the air compressor and a cooling system of the prior art.

Aspects of a typical engine driven air compressor system are shown in FIG. 2. In this system, a compressor 10, such as an oil-flooded monoscrew compressor described above, includes an air inlet valve 12 for providing air to air end of the compressor. An air hose 13 supplies air from an air filter 14 to the air inlet valve 12. Oil is provided to the compressor 10 by way of an oil inlet valve 16. An oil inlet hose 17 is connected between an oil filter 18 and the oil inlet valve 16.

A discharge check valve 20 is provided at the outlet end of the monoscrew compressor. An air/oil mixture is discharged from the outlet 20 through a discharge hose 22 to the inlet 29 of an air/oil separator 24. The air/oil separator is of known construction and provides a means for separating the compressed air from the lubricating oil. The air/oil separator includes an oil fill 26 and an oil drain 27, along with a relief valve 28 to prevent over-pressure of the separator. The air/oil mixture provided at the inlet 29 is separated within the separator 24 so that the compressed air passes from the separator through an air outlet 31. Oil is discharged from the separator by way of a cooling oil outlet 32 and an oil return line 34. Oil passing through the return line 34 is not cooled but is simply fed back to the oil filter 18 inlet. The oil return line 34 has a smaller flow area than the cooling oil outlet 32 so that most of the oil from the separator 24 is cooled before being returned to the compressor. Oil flow and pressure at both oil outputs 32 and 34 are maintained by the operation of the compressor 10.

The oil discharged from the separator at the cooling oil outlet 32 is fed through a coolant oil line 36 to some type of oil cooling system connected across the compressor system. In FIG. 2, the oil cooling system is shown as being connected across junction points A and B which have been added for illustrative purposes only. One type of cooling system of the prior art includes an air/oil heat transfer cooler 38. A pair of fans 40 blow across the core fins of the air/oil heat transfer cooler 38 to dissipate the heat conveyed by the oil through the cooler 38. In other words, the heat transfer cooler 38 operates as a typical radiator device found in many vehicles. The oil thus cooled is passed through a cool oil return line 42 to the oil filter 18 to be fed to the compressor 10. In many systems, an oil bypass line 44 is provided that is controlled by a thermostatic valve 46. When the oil is below a specific temperature, the thermostatic valve 46 opens to permit the oil to travel through the bypass 44 directly to the compressor 10 without first passing through the radiator cooler 38. When the oil is heated above a particular temperature, the thermostatic valve 46 operates to close the bypass 44 requiring the oil to pass through the heat transfer cooler 38 to cool the oil to the specific set temperature.

Figure 3:
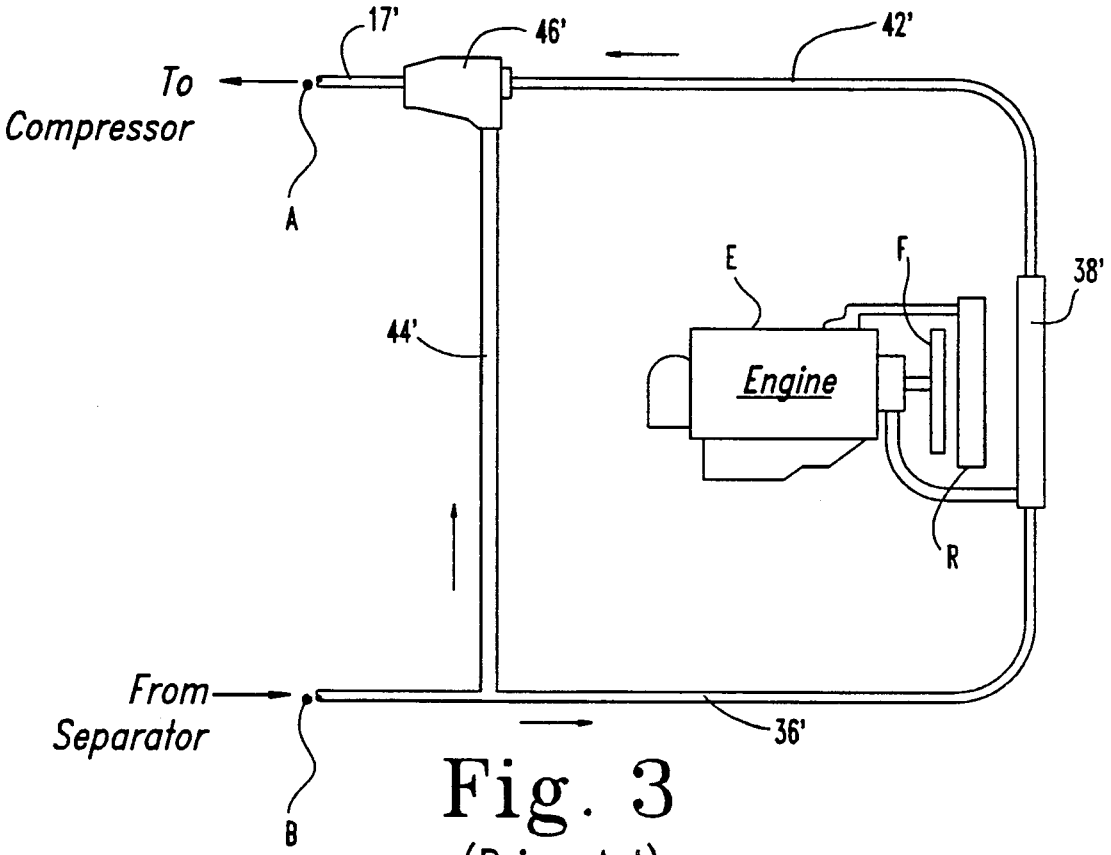
Fig. 3 (Prior Art)
FIG. 3 is a schematic representation of a second cooling system of the prior art for use with the compressor shown in FIG. 2.

A second cooling system found in the prior art is illustrated in FIG. 3. This system replaces the cooling system shown in FIG. 2 at the junctions A and B so that the compressor components are the same as shown in FIG. 2. In this second system of the prior art, a coolant oil line 36' conveys oil from the air/oil separator to a separate compressor oil radiator or air/oil cooler 38'. This radiator 38' is disposed in front of the vehicle radiator R which provides cooling to the vehicle engine E. An engine driven fan F blows air across both the vehicle radiator and the compressor oil radiator 38'. The cooled oil is passed on the return line 42' to the inlet oil line 17', as in the previous system shown in FIG. 2. One such system employing a separate cooling radiator for the compressor oil is shown in the patent to Sawyer, U.S. Pat. No. 3,153,508. One problem with this system is that the additional radiator 38' can reduce air flow across the engine radiator R when the vehicle is operated under driving conditions.

Figure 4:
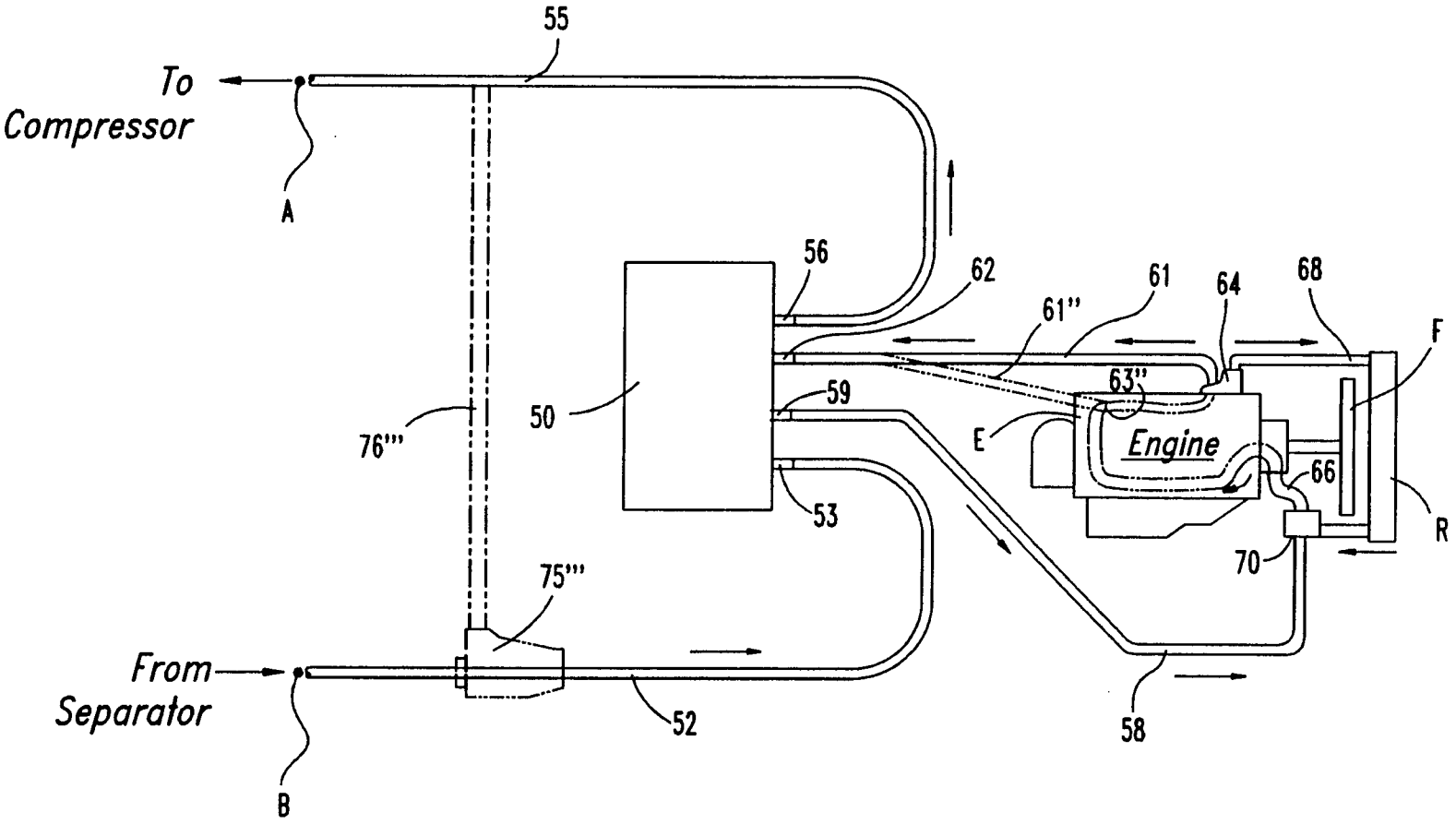
FIG. 4 is a schematic representation of the compressor cooling system of the present invention for use with the compressor system and in lieu of the cooling system shown in FIGS. 2 or 3.

The compressor oil cooling system of the present invention is shown in FIG. 4. The cooling system of the invention is an improvement over the prior art systems shown in FIGS. 2 and 3, because, for example, it eliminates the expense of the thermo bypass valve, and its plumbing fittings and hoses, of the prior art system shown in FIG. 2, as well as the expense of the additional air/oil cooler of the system shown in FIG. 3. In the preferred embodiment of the present invention the cooling system is installed between the junction A and B (see FIG. 2) that is between compressor oil filter 18 and the cooling oil outlet 32. The components of the compressor system, including the air/oil separator are identical to those components described above.

In the present embodiment, an oil/coolant heat exchanger 50 is provided to cool or heat the oil leaving the separator and returning to the compressor. A separator oil line 52 is connected to the separator outlet 31 to convey oil along that line in the direction of the arrow to an oil inlet 53 of the oil/coolant heat exchanger 50. Cooler oil leaves the oil/coolant heat exchanger 50 through oil outlet 56 and passes along compressor oil line 55 to the oil filter 18 in the compressor system.

The oil cooling system of the present invention includes a coolant flow path through the oil/coolant heat exchanger 50. This coolant flow path is integrated directly into the cooling system of the vehicle engine so that the oil/coolant heat exchanger 50 uses the same coolant that is used to cool the engine E during operation. In the preferred embodiment the coolant is water, although antifreeze or other similar liquid coolant may be used depending upon the heat transfer requirements of the system. A coolant discharge line 58 directs warm coolant from a coolant outlet 59 of the oil/coolant heat exchanger 50 to the engine coolant discharge line 66 at the inlet of the engine coolant pump 70. As shown in FIG. 4, the engine coolant discharge line 66 is coupled to an air/water cooler, such as a radiator R, which may be of conventional design. A fan F flows air across the radiator to cool the water flowing therethrough. The radiator includes an engine coolant inlet line 68 that takes the heated water from the engine block, preferably at the thermostat housing 64. The radiator R, fan F, thermostat housing 64, coolant discharge line 66 and coolant inlet line 68 form a conventional engine cooling system.

The liquid coolant, or water, is also dispersed to the oil/coolant heat exchanger 50 through a coolant inlet line 61 connected between the thermostat housing 64 and the inlet 62 of the oil/coolant heat exchanger 50. Warm coolant that has had its temperature increased by heat transfer from the oil passing through the cooler 50 flows along coolant discharge line 58 to the engine coolant pump 70 to mix with the cooled coolant discharged by the radiator along engine coolant discharge line 66. Warm coolant flows through the radiator R and is cooled in an air/coolant heat transfer by air across the radiator R by the fan F. The warm coolant flows through the cooling lines of the engine block into the thermostat housing 64 of the engine E where part of the coolant flows directly through the coolant inlet line 68 and another part flows through the coolant inlet line 61 directly to the oil/coolant heat exchanger. Thus, a continuous supply of liquid coolant is provided not only to the engine but also to the oil/coolant heat exchanger 50 for the compressor cooling system. The coolant pump 70 of the engine provides the flow of coolant through all the coolant lines.

In an alternative version of the invention, a coolant inlet line 61'' is connected to the coolant manifold inlet 63'' of the engine, rather than through the thermostat housing 64 as in the previous arrangement. Which of the inlet line 61 or the inlet line 61'' configuration is used in a given application depends upon the configuration of the engine itself. If the engine has a convenient connection at the coolant manifold inlet 63'' then the alternative inlet line 61'' may be preferable. However, if the thermostat housing 64 is readily available for such connection, then the coolant inlet line 61 may be preferable.

In either configuration, it is essential that the supply of coolant to the oil/coolant heat exchanger 50 is not shut off by the engine thermostat. In a conventional engine cooling system, a thermostatic valve controls flow through a bypass line as the coolant temperature falls below the thermostat set point in order to keep the coolant, and therefor the engine, at its optimum operating temperature. Thus, in the present invention, coolant flowing through either coolant inlet line 61 or inlet line 61'' must exit the engine cooling system after the engine thermostat, or upstream of the bypass line, or may be part of the bypass line, to insure flow of coolant to the oil/coolant heat exchanger even when the engine thermostat has closed the engine engine coolant inlet line 68.

Since the coolant for the oil/coolant heat exchanger 50 is commingled with the coolant flowing through the engine, the desired temperature range for the compressor cooling system can be maintained without the need for a separate thermostatic valve for the compressor cooling system (such as shown in the prior system of FIG. 2). When the engine coolant flow is controlled by the engine thermostat within housing 64, the coolant continues to flow through the radiator R and into the oil/coolant heat exchanger 50 by the operation of the engine coolant pump 70. If the engine temperature increases to the set point of the engine thermostat, the thermostat will be at its maximum opening permitting flow of coolant through the radiator R providing coolant for the engine, as well as through the oil/coolant heat exchanger 50.

The oil/coolant heat exchanger can be of conventional design. The oil/coolant heat exchanger 50 of the preferred embodiment is of conventional design. Other liquid to liquid heat exchangers may be substituted if they have the requisite heat transfer capacity to adequately cool the compressor oil passing therethrough. In one specific embodiment, the oil/coolant heat exchanger is a compact plate-type cross-flow heat exchanger sold by I.T.T. Standard Co. as Model No. 6X15–38. This specific oil/coolant heat exchanger has overall outside dimensions of $6\frac{1}{8}'' \times 15\frac{1}{4}'' \times 5''$ so that it can easily fit within a typical 8'' vehicle frame rail. Preferably, the oil/coolant heat exchanger is mounted so that the heater hoses slope upward to the engine to avoid trapping air in the oil/coolant heat exchanger 50 or the hoses. In this specific embodiment, the oil/coolant heat exchanger is plumbed for "cross flow" to insure maximum heat exchange between the oil and coolant.

In one specific embodiment, the coolant flow through the oil/coolant heat exchanger 50 is at least 15 gallons per minute. This coolant flow is maintained by the coolant pump 70 associated with the vehicle engine. In a typical installation, the compressor oil/coolant heat exchanger 50 will add between 1148 btu/min. and 1488 btu/min. to the engine coolant. In most cases, the engine cooling system, including the radiator R and fan F, is adequate to handle the amount of heat added by the heat transfer from the oil of the compressor to the coolant. In this instance, the amount of heat added by the compressor oil is small compared to the total engine heat rejection while it is operating to provide power to the compressor 10 by way of the power take off (PTO). However, for vehicles with smaller engines such as engines smaller than 200 horsepower, a larger engine fan may be necessary to provide higher air flow across the radiator to cool the engine coolant after the addition of the heat from the oil/coolant heat exchanger 50 heat exchange. Since the vehicle is necessarily stopped when the power take-off is driving the compressor, there is no additional cooling provided by the ram air flow of the vehicle as it travels, thus the smaller engine may require a larger fan with larger air flow capabilities.

In the preferred embodiment, the separator oil line 52 and the compressor oil line 55 include a hydraulic hose, such as the one inch Stratoflex No. 213 or the Aeroquip No. FC198 hydraulic hose. The coolant discharge line 58 and coolant inlet line 61 can be the typical 1 inch or $1\frac{1}{4}$ inch heater hose used for the engine cooling system. Hence the present invention does not require a separate air/oil heat exchanger such as the radiators 38 and 38' of the prior art systems. There is also no need for the more expensive hydraulic hoses, which have been replaced by the relatively inexpensive heater hoses of the specific embodiment. Preferably, the oil/coolant heat exchanger 50 is located as close as possible to the compressor 10 in order to keep the high pressure, expensive, oil lines 52 and 55 as short as possible.

The benefits of the compressor cooling system of the invention shown in the embodiment of FIG. 4 extends beyond simply reducing the expense of the system from that of prior art systems. The present arrangement in which the compressor cooling system is married with the engine cooling system also permits the use of engine waste heat to warm the compressor oil during compressor warm up or partial loading conditions. This can be particularly important for compressors used in very cold temperatures. Since the engine thermostat in essence controls the temperature of the coolant flowing through the engine and the oil/coolant heat exchanger 50, a single thermostat adequately keeps both components, the engine and the compressor, within their operating temperature ranges. Likewise, when the compressor has been operated, compressor heat is conveyed from the oil to the coolant, which is in turn conveyed into the engine cooling system. This aspect of the system provides for faster warm up of the engine itself under starting and quick loading conditions.

In a further alternative embodiment of the present invention, a thermostatic valve 75''' and bypass line 76''' can be provided between the separator oil line 52 and the compressor oil line 55. In this instance, the thermostatic valve 75''' would operate in a manner similar to that of the system in FIG. 2. The thermostatic valve 75''', however, can have a set temperature much higher than the set temperature of the engine thermostat which controls the coolant temperature through the oil/coolant heat exchanger. This additional thermostatic valve 75''' may be provided for heavy duty or large compressors to ease the burden on the engine cooling system itself, particularly if the engine has a low horsepower capability. However, the bypass line 76''' and valve 75''' are intended as an auxiliary to the basic engine-compressor coolant system interrelationship.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A compressor cooling system for an oil-flooded air compressor for use in conjunction with an engine cooling system, the air compressor having an oil inlet and an oil outlet, and the engine cooling system having an engine cooling path including cooling passages in the engine block, with a coolant flowing therethrough, the cooling path including an engine heat exchanger having a coolant inlet and a coolant outlet, and a coolant pump, the engine cooling system further having a bypass line to the coolant pump in parallel with the engine heat exchanger, and a thermostat valve for bypassing coolant flow away from the heat exchanger through the bypass line to control the temperature of the coolant, said compressor cooling system comprising:

an oil flow path defined from the oil outlet to the oil inlet of the air compressor;

a compressor coolant flow path defined between an inlet to the coolant pump and a fluid intersection with the engine cooling path on the opposite flow side of the thermostat valve from the engine heat exchanger coolant inlet at a location where coolant has at least substantially traversed through cooling passages in the block of the engine;

an oil/coolant heat exchanger interposed in heat exchange relation between said oil flow path and said compressor coolant flow path for transferring heat between oil flowing through said oil flow path and coolant flowing through said compressor coolant flow path, wherein said compressor coolant flow path is the only path for coolant through said oil/coolant heat exchanger, and further wherein said compressor coolant flow path is in parallel with the engine heat exchanger so that coolant flow through said compressor coolant flow path is not diminished when the thermostat valve bypasses coolant flow away from the engine heat exchanger.

2. The compressor cooling system of claim 1 in which the engine cooling system includes an engine cooling manifold port into the engine cooling path at the engine, wherein said fluid intersection is at the engine cooling manifold port.

3. The compressor cooling system of claim 1 in which the engine cooling system includes a thermostat housing, wherein said fluid intersection is at the thermostat housing.

4. The compressor cooling system of claim 1, wherein said compressor cooling path is interposed in series with the bypass line.

* * * * *